US011629000B2

(12) United States Patent
Chen

(10) Patent No.: US 11,629,000 B2
(45) Date of Patent: Apr. 18, 2023

(54) BUFFER PACKAGING

(71) Applicant: Forever Lucky Co., Ltd., Tainan (TW)

(72) Inventor: Mei-Jun Chen, Tainan (TW)

(73) Assignee: FOREVER LUCKY CO., LTD., Tainan (TW)

( * ) Notice: Subject to any disclaimer, the term of this patent is extended or adjusted under 35 U.S.C. 154(b) by 0 days.

(21) Appl. No.: 17/473,159

(22) Filed: Sep. 13, 2021

(65) Prior Publication Data

US 2023/0083137 A1 Mar. 16, 2023

(51) Int. Cl.
*B65D 81/05* (2006.01)
*B65D 81/127* (2006.01)

(52) U.S. Cl.
CPC ..... *B65D 81/127* (2013.01); *B65D 2581/053* (2013.01)

(58) Field of Classification Search
CPC ..... B65D 81/053; B65D 2581/053; B65D 81/051; B65D 81/127; B65D 65/44; B65D 81/05
USPC ..... 206/521, 591, 592, 588
See application file for complete search history.

(56) References Cited

U.S. PATENT DOCUMENTS 4,865,889 A * 9/1989 Boyse ..... B65D 65/44 428/116
5,413,823 A * 5/1995 Lo Presti ..... B60P 7/135 428/116
5,413,824 A * 5/1995 Van Erden ..... B65D 19/0002 428/116
8,256,488 B2 * 9/2012 Ruggles ..... E06B 9/262 160/84.01
2005/0167557 A1 * 8/2005 Winckels ..... B65D 65/44 248/311.2
2006/0266668 A1 * 11/2006 Bezar ..... B65D 77/00 206/457
2013/0140213 A1 * 6/2013 Padden ..... B65D 5/48026 428/116
2017/0314845 A1 * 11/2017 Tang ..... H04R 1/026
2020/0231328 A1 * 7/2020 Wang ..... B65D 5/5016

FOREIGN PATENT DOCUMENTS

CN 100999269 A 7/2007
CN 203806409 U 9/2014

* cited by examiner

*Primary Examiner* — Steven A. Reynolds
(74) *Attorney, Agent, or Firm* — Muncy, Geissler, Olds & Lowe, P.C.

(57) ABSTRACT

A buffer packaging is provided. The buffer packaging includes a main body and at least one support plate. The main body is stretchable in a stretching direction and includes at least one receiving hole. The at least one support plate is connected with the main body and is swingable between a first position and a second position.

7 Claims, 6 Drawing Sheets

BUFFER PACKAGING

BACKGROUND OF THE INVENTION

Field of the Invention

The present invention relates to a buffer packaging.

Description of the Prior Art

Generally, packaging paper should at least meet following requirements: easy to decompose, high strength, low cost, good air permeability and light weight. CN100999269 discloses the like packaging box with an inner case, and CN203806409 discloses the like packaging box for packaging watermelon. The above-mentioned conventional packaging structure can provide buffering to the product, and it can be stacked (space-saving) and is lightweight. However, the above-mentioned conventional packaging structure has problems of being not conducive to storage and transportation.

The present invention is, therefore, arisen to obviate or at least mitigate the above-mentioned disadvantages.

SUMMARY OF THE INVENTION

The main object of the present invention is to provide a buffer packaging which provides good protection and buffering to an object to be packaged.

To achieve the above and other objects, a buffer packaging is provided, including: a main body, stretchable in a stretching direction, including at least one receiving hole; and at least one support plate, connected with the main body, being swingable between a first position and a second position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
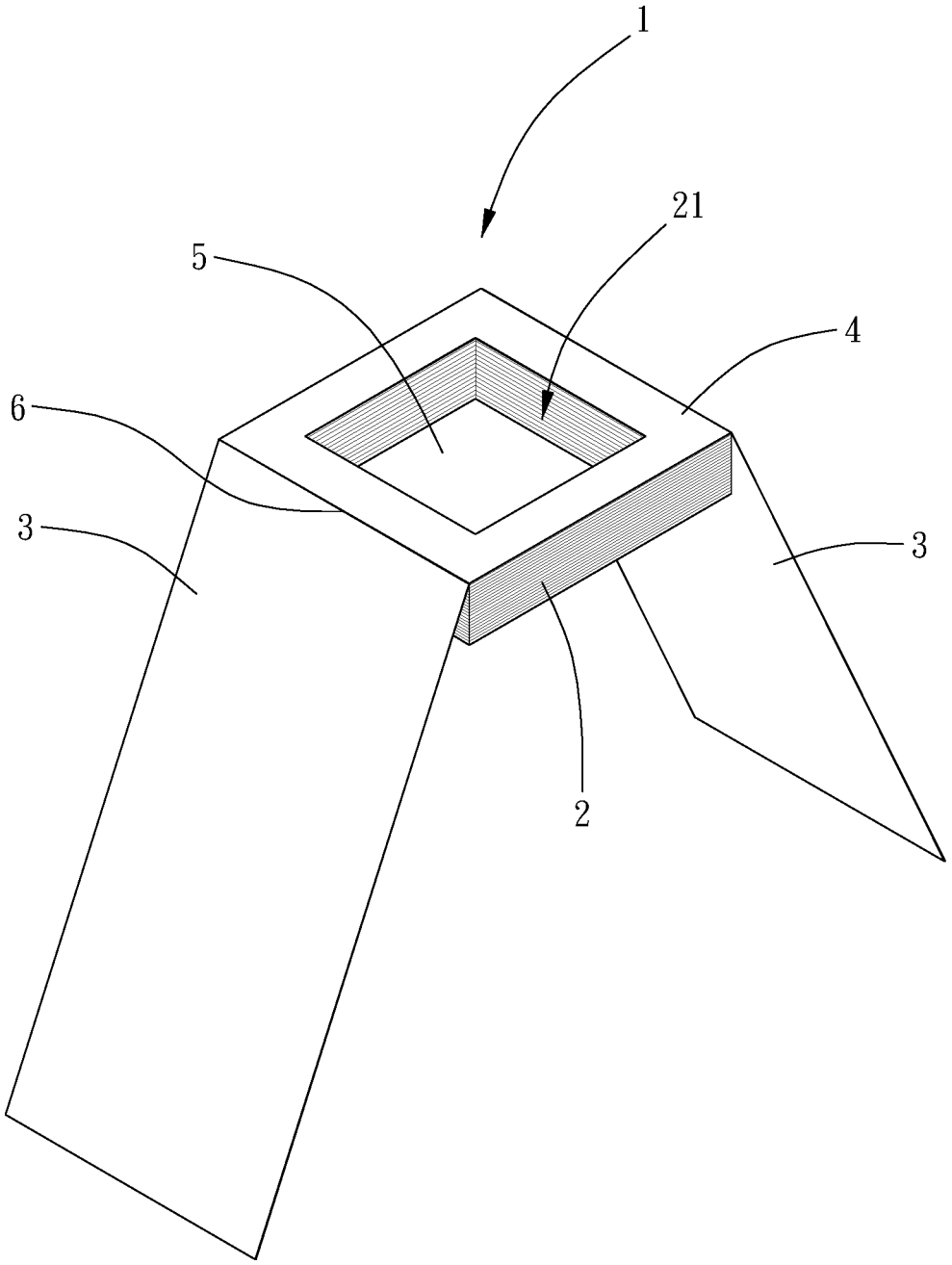
FIG. 1 is a stereogram of a buffer packaging of a preferable embodiment of the present invention.
Figure 2:
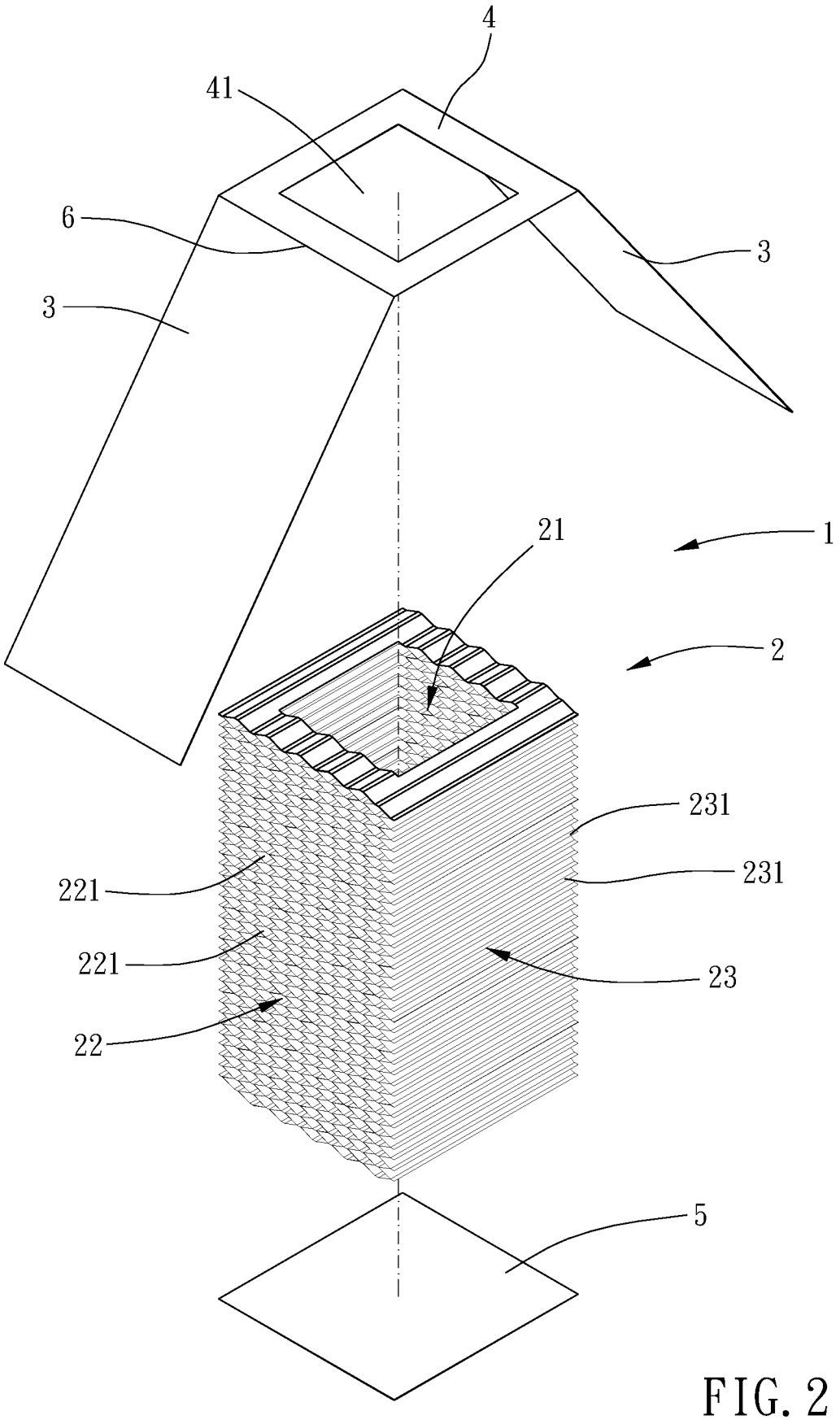
FIG. 2 is a breakdown drawing of the buffer packaging of a preferable embodiment of the present invention.
Figure 3:
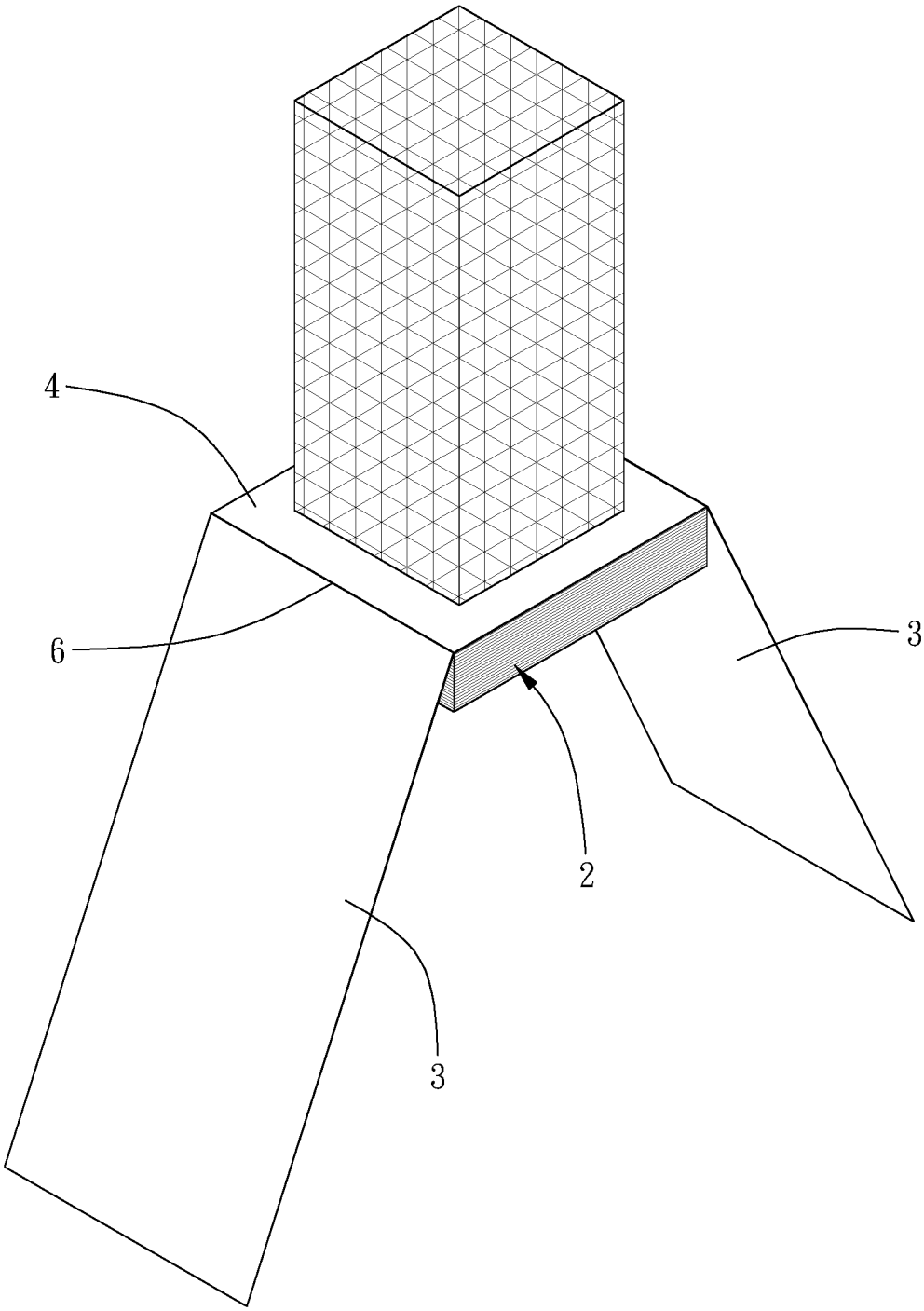
FIGS. 3 and 4 are drawings showing operation of the buffer packaging according to a preferable embodiment of the present invention.

Please refer to FIGS. 1 to 6 for a preferable embodiment of the present invention. A buffer packaging 1 of the present invention includes a main body 2 and at least one support plate 3.

The main body 2 is stretchable a stretching direction, and includes at least one receiving hole 21.

The at least one support plate 3 is connected with the main body 2, and is swingable between a first position and a second position. In this embodiment, the buffer packaging 1 includes two said support plates 3, and the two said support plates 3 are located at opposing sides of the main body 2.

In use, an object is disposed into the receiving hole 21 of the buffer packaging 1, the main body 2 is stretched to elongate in the stretching direction so that the object can be sufficiently encompassed by the main body 2; and the two said support plates 3 swings to be parallel to the stretching direction so that the two said support plates 3 provide good support to the main body 2 in the stretching direction. As a result, it provides good protection and buffering to the object, to avoid impact and/or damage to the object.

The two said support plates 3 may swing to be non-parallel (preferably perpendicular) to the stretching direction and the main body 2 is shrunk, so that a plurality of main bodies 2 can be stacked, which is space-saving, easy to store and transport.

A packaging box is further provided. The packaging box includes at least one said buffer packaging 1, and further includes a box body 9. The box body 9 includes a plurality of side walls 91, the plurality of side walls 91 define a receiving space, the buffer packaging 1 is received in the receiving space, and each of the two said support plates 3 is parallel to one of the two side walls 91 so as to correspondingly cooperate with the box body 9 to sufficiently and stably position the object in the box body 9.

Figure 4:
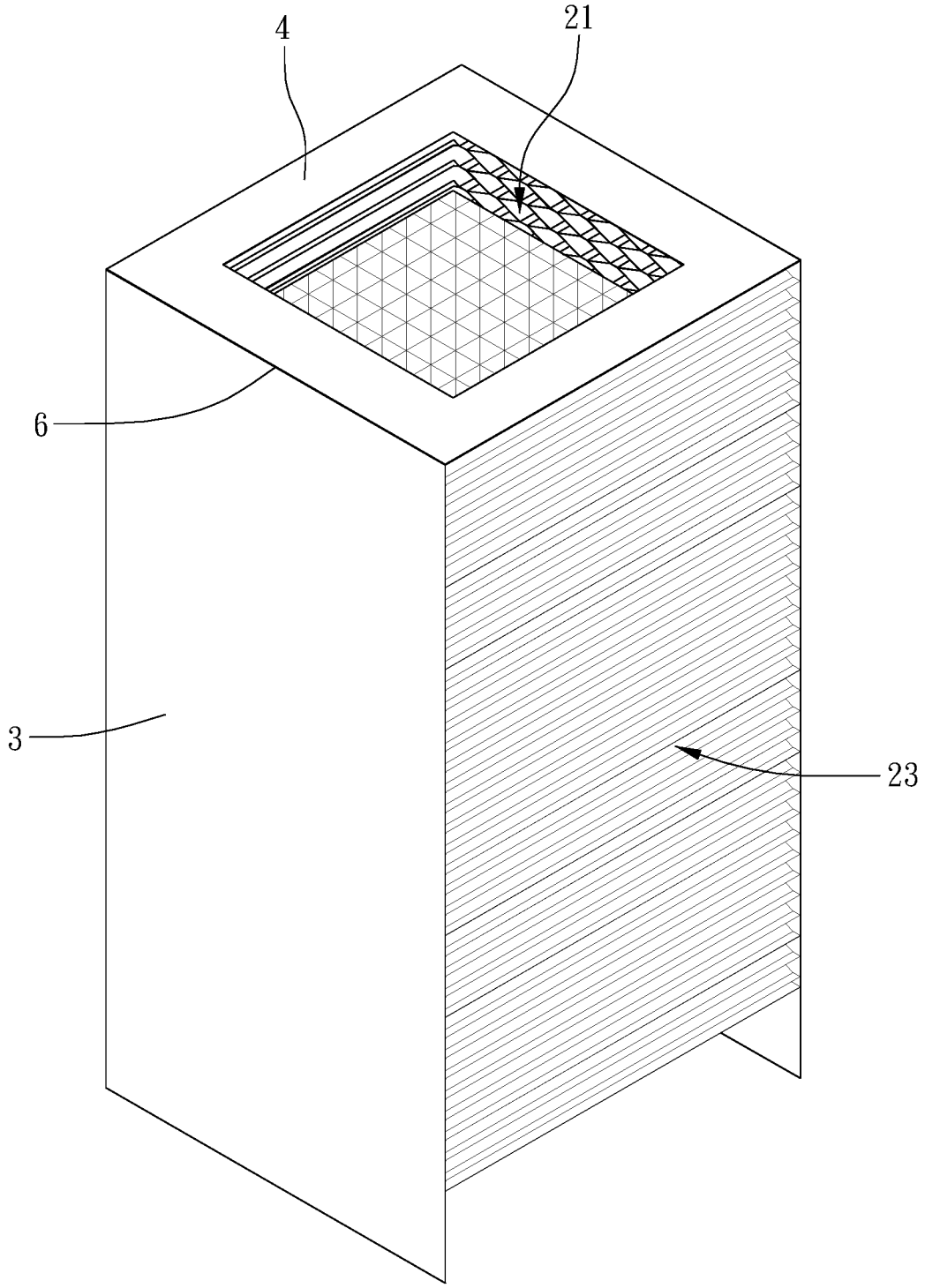
Figure 5:
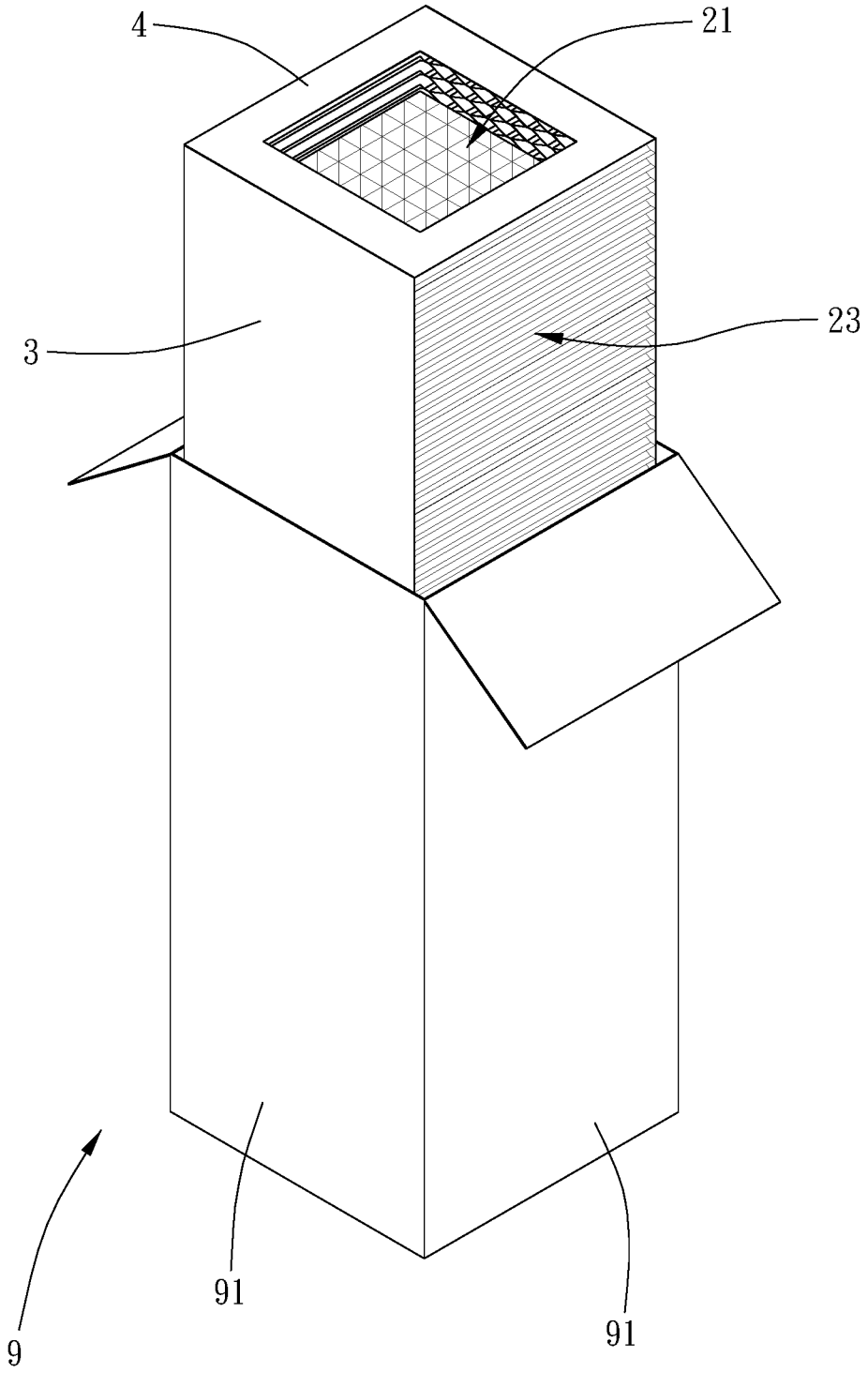
FIG. 5 is a stereogram of a packaging box of a preferable embodiment of the present invention.
Figure 6:
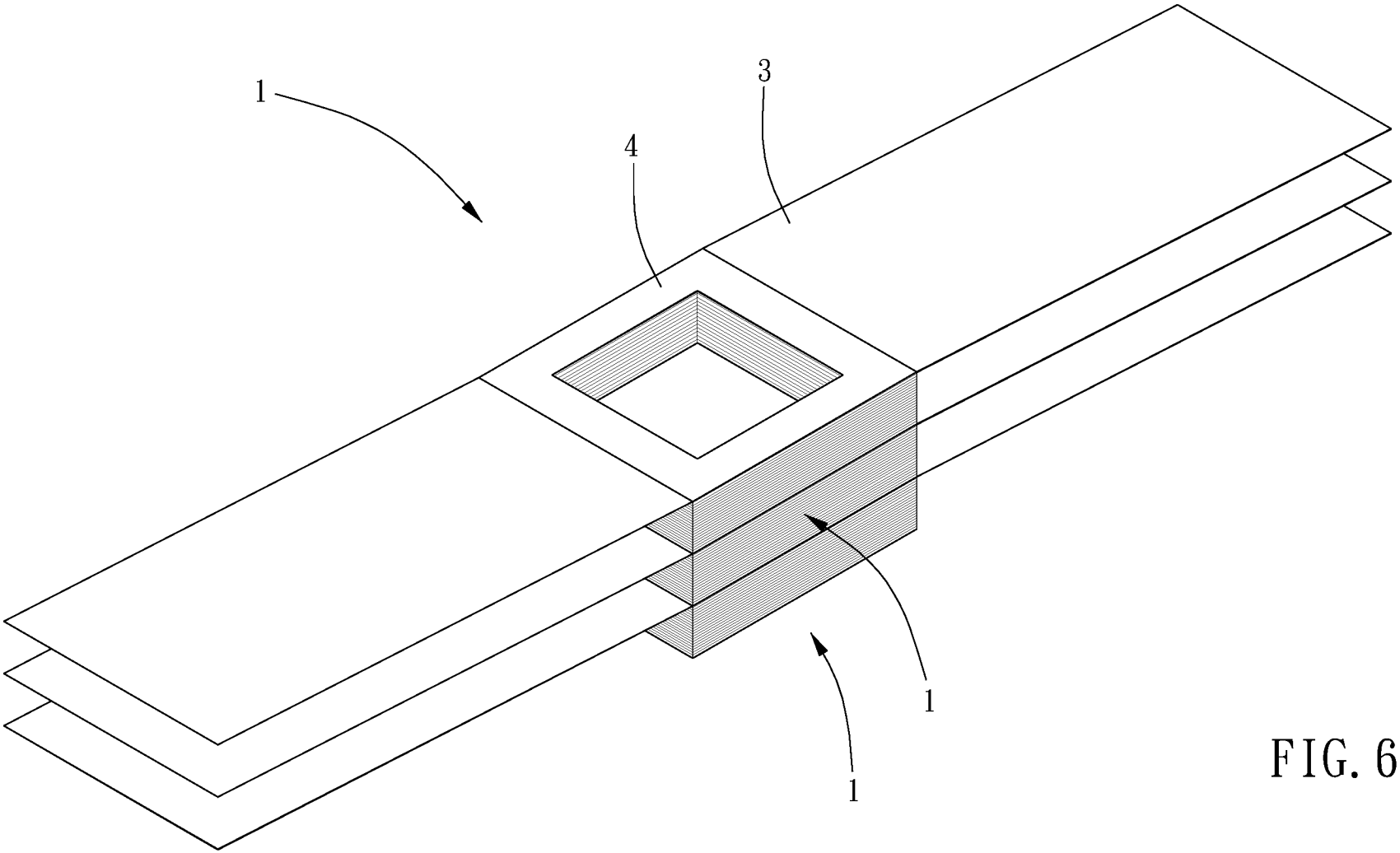
FIG. 6 is a drawing showing packaging boxes stacked according to a preferable embodiment of the present invention.

Specifically, the buffer packaging 1 further includes an upper plate 4, the upper plate 4 is fixedly connected (adhered, or stapled) to a side of the main body 2 lateral to the stretching direction, so as to protect the main body 2 from being damaged. When the support plate 3 swings to the second position, the support plate 3 is parallel to the stretching direction (as shown in FIG. 4). Preferably, there is a folding line 6 between each of the at least one support plate 3 and the upper plate 4, and the support plate 3 is swingable about the folding line 6 relative to the upper plate 4.

The upper plate 4 includes at least one through hole 41, and each of the at least one through hole 41 corresponds to one of the at least one receiving hole 21, and the upper plate 4 has an outline substantially the same as an outline of the side of the main body 2 to which the upper plate 4 is fixedly connected, wherein the at least one through hole 41 is provided for insertion of the object. In this embodiment, each of the at least one support plate 3 is integrally connected with a side of the upper plate 4 lateral to the stretching direction, which facilitates fixation of the two said support plates 3 to the main body 2. In other embodiments, the two said support plates 3 may be additionally adhered to the main body 2.

Preferably, the buffer packaging 1 further includes a lower plate 5, and the lower plate 5 is fixedly connected to a side of the main body 2 opposite to the upper plate 4. When the object is inserted into the receiving hole 21, the lower plate 5 is driven downward by the object so that the main body 2 is stretched and elongates so as to encompass the object. Specifically, the main body 2 is cuboid, and the upper plate 4 and the lower plate 5 are cuboid and correspond to the main body 2 in shape.

Specifically, the main body 2 includes two first sides 22 opposite to each other and two second sides 23 opposite to each other, and the two first sides 22 and the second side 23 extend in the stretching direction. Each of the at least one support plate 3 has a width substantially equal to a width of one of the first side 22 and the second side 23. When each of the at least one support plate 3 swings to be parallel to the stretching direction, each of the at least one support plate 3 is covered on one of the first side 22 and the second side 23.

In this embodiment, each of the at least one support plate 3 swings to be parallel to the stretching direction, each of the at least one support plate 3 is covered on the first side 22, to protect the first side 22 from being pressed and deformed.

In this embodiment, the main body 2 is a honeycomb paper structure, each of the two first sides 22 includes a plurality of honeycombs 221 which are stretchable, and each of the two second sides 23 includes a plurality of pleats 231 which are stretchable, so that the main body 2 is capable of large stretch.

Preferably, the receiving hole 21 extends through the main body 2 in the stretching direction, which provides good protection to the object. The upper plate 4, the at least one support plate 3 and the lower plate 5 are preferably made of cardboard, which provides sufficient support and is durable.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A buffer packaging, including:

a main body, stretchable in a stretching direction, including at least one receiving hole;

at least one support plate, connected with the main body, being swingable between a first position and a second position;

an upper plate, wherein the upper plate is fixedly connected to a side of the main body lateral to the stretching direction, and when the support plate swings to the second position, the support plate is parallel to the stretching direction; and a lower plate, wherein the lower plate is fixedly connected to a side of the main body opposite to the upper plate, and the lower plate is movable with the main body in the stretching direction, wherein the upper plate includes at least one through hole, each of the at least one through hole corresponds to and aligns with one of the at least one receiving hole, and an opening of each of the at least one through hole has a fixed area the same as an area of an opening of one of the at least one receiving hole, and wherein there is a folding line between each of the at least one support plate and the upper plate, the support plate is swingable about the folding line relative to the upper plate, and a length of the support plate from the folding line to an end of the support plate in a direction perpendicular to the folding line is larger than a length of the upper plate in a direction perpendicular to the folding line.

2. The buffer packaging of claim 1, wherein the upper plate has an outline substantially the same as an outline of the side of the main body to which the upper plate is fixedly connected.

3. The buffer packaging of claim 1, wherein each of the at least one support plate is integrally connected with a side of the upper plate lateral to the stretching direction.

4. The buffer packaging of claim 1, wherein the main body includes two first sides opposite to each other and two second sides opposite to each other, the two first sides and the two second sides extend in the stretching direction, each of the at least one support plate has a width substantially equal to a width of one of the first side and the second side, and when each of the at least one support plate swings to be parallel to the stretching direction, each of the at least one support plate is covered on one of the first side and the second side.

5. The buffer packaging of claim 4, wherein the main body is a honeycomb paper structure, each of the two first sides includes a plurality of honeycombs which are stretchable, and each of the two second sides includes a plurality of pleats which are stretchable.

6. The buffer packaging of claim 1, wherein the main body is cuboid, the upper plate is looped, and the lower plate is rectangular.

7. The buffer packaging of claim 3, wherein the upper plate has an outline of substantially the same as an outline of the side of the main body to which the upper plate is fixedly connected; the main body includes two first sides opposite to each other and two second sides opposite to each other, the two first sides and the two second sides extend in the stretching direction, each of the at least one support plate has a width substantially equal to a width of one of the first side and the second side, and when each of the at least one support plate swings to be parallel to the stretching direction, each of the at least one support plate is covered on one of the first side and the second side; the main body is a honeycomb paper structure, each of the two first sides includes a plurality of honeycombs which are stretchable, and each of the two second sides includes a plurality of pleats which are stretchable; the main body is cuboid, the upper plate is looped, and the lower plate is rectangular; the at least one receiving hole extends through the main body in the stretching direction, the upper plate, the at least one support plate and the lower plate are made of cardboard.

* * * * *